US008235733B2

(12) United States Patent
Yamashiro et al.

(10) Patent No.: US 8,235,733 B2
(45) Date of Patent: Aug. 7, 2012

(54) ELECTRICAL CONNECTOR FOR CIRCUIT BOARD

(75) Inventors: Naoya Yamashiro, Tokyo (JP); Yohei Michida, Tokyo (JP); Fumio Oshita, Toyama (JP); Tomoaki Katou, Toyama (JP); Hiroki Hayashi, Toyama (JP)

(73) Assignees: Hirose Electric Co., Ltd., Tokyo (JP); Takamatsu Plating Co., Ltd., Toyama (JP)

( * ) Notice: Subject to any disclaimer, the term of this patent is extended or adjusted under 35 U.S.C. 154(b) by 30 days.

(21) Appl. No.: 12/883,435

(22) Filed: Sep. 16, 2010

(65) Prior Publication Data

US 2011/0070752 A1 Mar. 24, 2011

(30) Foreign Application Priority Data

Sep. 18, 2009 (JP) ..... 2009-217398

(51) Int. Cl.
*H01R 12/14* (2006.01)

(52) U.S. Cl. ..... 439/83; 439/74

(58) Field of Classification Search ..... 439/83, 439/74, 876

See application file for complete search history.

(56) References Cited

U.S. PATENT DOCUMENTS 5,453,017 A * 9/1995 Belopolsky ..... 439/83

FOREIGN PATENT DOCUMENTS

| | | |
|---|---|---|
| JP | 2006-318833 A | 11/2006 |
| JP | 2008-226681 | 9/2008 |
| JP | 2008-300193 A | 12/2008 |

* cited by examiner

*Primary Examiner* — Neil Abrams

(74) *Attorney, Agent, or Firm* — Kubotera & Associates, LLC

(57) ABSTRACT

In an electrical connector to be attached to a circuit board, a terminal has a contact section on one free end side to contact with a terminal of a mating connector and has a connecting section on the other free end side to be connected by soldering to a circuit portion of a circuit board. The terminal has a holding section and a connecting section. The holding section has a face-contact section, a backside section, and a side-face section. The terminal has a low solder wetting area at least on a part of a circumferential area of the holding section in the longitudinal direction, and the contact section is formed above the upper end of the low solder wetting area on the backside section. The upper end of the low solder wetting area is provided below the upper end at the side-face sections and the contact-face section.

5 Claims, 7 Drawing Sheets

ELECTRICAL CONNECTOR FOR CIRCUIT BOARD

BACKGROUND OF THE INVENTION AND RELATED ART STATEMENT

The present invention relates to an electrical connector for a circuit board.

An electrical connector for a circuit board is connected by soldering connecting sections of terminals of the connector to a corresponding circuit portion of a circuit board upon attaching to the circuit board. A connector of this type has been known as one disclosed in Patent Reference.

Patent Reference: Japanese Patent Publication No. 2008-226681

The connector of Patent Reference has a housing having a circumferential wall, which extends orthogonally to a circuit board surface to receive a mating connector, and the terminals are integrally molded onto the facing side walls of the circumferential wall. Each terminal has a contact section provided along an inner surface of the side wall and a connecting section that is bent at its end and extends outside the housing. Each terminal contacts with a terminal of a mating connector at the contact section, and is connected by soldering at the connecting section to a corresponding circuit portion of a circuit board.

In the connector of Patent Reference, each terminal has in its longitudinal direction, a first and a second low solder wetting areas on a circumferential surface, which is a portion between a connecting section and a housing side wall, and a lower face of a portion, where the terminal is integrally molded and thereby held by the side wall of the housing, respectively. According to Patent Reference, if the connecting section of each terminal is connected to a circuit board by soldering, the solder wicking is restricted at the first and the second low solder wetting areas.

In the connector of Patent Reference, the terminals are integrally molded to the housing and thereby held therein, so that the side walls of the housing, which hold the circumferential surface of each terminal tightly contacts with a circumferential surface of the terminal. Therefore, except of unexpected situation such as partial peeling to impair the tight contact, there is no concern of solder wicking. Accordingly, it is also possible to consider that the first and the second low solder wetting areas are for the unexpected situation like the aforementioned partial peeling.

Regardless whether the terminals are integrally molded to the housing, in case of a connector to be attached to a wall of housing after molding, since small space is formed between a terminal and a wall of the housing, it is necessary to make sure to prevent solder wicking. Generally speaking, for prevention against solder wicking, as described in Patent Reference, a low solder wetting area such as nickel plating is formed on a circumferential surface of a portion between a connecting section and a contact section of each terminal.

Since terminals are required to have good conductivity, each terminal includes a nickel plating layer as a base layer on a base material surface, and a gold plating layer, which is a high solder wetting material and has good conductivity, as an upper layer thereon. To form a low solder wetting area, the gold plating layer is removed or melted at the portion by laser or the like, and as a result, the nickel layer is exposed and thereby a low solder wetting area is formed.

While the connecting section has to be well soldered to a circuit portion of a circuit board, the contact section has to secure the gold plating layer with good conductivity as wide as possible. More specifically, while the connecting section and the contact section are required to be formed wide as high solder wetting areas, the low solder wetting area provided between the connecting section and the contact section is required to be formed in an area that is as wide as possible to make sure prevention against solder wicking.

Accordingly, the high solder wetting areas at the connecting section and the contact section and the low solder wetting area provided therebetween require to satisfy contradictory conditions. In this circumstance, it is difficult to meet the contradictory conditions also in view of the low profile demand.

In view of the above, there is provided an invention, an object of which is to provide an electrical connector for a circuit board, which can securely prevent solder wicking in a low solder wetting area between the connecting sections and contact sections of terminals while maintaining good soldering property at the connecting sections and good electrical conductivity at the contact sections.

Further objects and advantages of the invention will be apparent from the following description of the invention.

SUMMARY OF THE INVENTION

According to the invention, an electrical connector for a circuit board is to be attached to a circuit board. Each terminal has a contact section on one free end side to contact with a terminal of a mating connector and has a connecting section on the other free end side to be connected by soldering to a circuit portion of a circuit board. In addition, each terminal has a holding section to be held by contacting to a wall section of housing, which is orthogonal to a surface of a circuit board, in the middle part of the terminal, and has a connecting section, which is formed by bending a lower end of the holding section and extends along a circuit board surface. The holding section has a face-contact section that contacts by face with the wall section, a backside section that is on the other side to the face-contact section, and a side-face section that connects between the face-contact section and the backside section. Each terminal has a low solder wetting area at least on a part of a circumferential area of the holding section in the longitudinal direction except the contact section and the connecting section, and the contact section is formed above the upper end of the low solder wetting area on the backside section.

According to the invention, the electrical connector for a circuit board like this is characterized by that the upper end of the low solder wetting area on the backside section is provided below the upper end at the side-face sections and the contact-face section.

According to the connector of the invention configured in this way, in each terminal, the holding section provided between the contact section and the connecting section has the low solder wetting area formed therearound at least partially in the longitudinal direction of the terminal. The circumferential surface is formed by a contact-face section that contacts by face with a wall section of the housing, side-face sections that are exposed outside but connect to the contact-face section, and a backside section that is exposed outside, provided opposite the contact-face section, and is most distant from the contact-face section. The solder wicking hardly occur in the order at the contact-face section, side-face sections, and the backside section.

Accordingly, at the backside section, the upper end of the low solder wetting area is set below the upper end of the contact-face section and the side-face sections, i.e., being closer to a circuit board surface to be connected by soldering. Even if the range of the low solder wetting area in the longitudinal direction is smaller, there is no solder wicking problem, and by lowering the upper end of the low solder wetting area on the backside section, the area of the contact section, which is provided thereabove, can be made broader. As a result, without interfering with the preventive effect against solder wicking on the back-face section, it is possible to enhance the secure contact with a terminal of the mating connector at the contact section. Therefore, according to the invention, it is possible to reduce the profile of a connector, and especially it is effective in a connector which is required to have lower profile.

In the invention, the low solder wetting area of each terminal can have a lower end at the bent section, which is a transitional portion from the holding section to the connecting section. By setting the lower end of the low solder wetting area to the bent section, it is possible to keep the range of the low solder wetting area broad, and more securely prevent the solder wicking. Even if the lower end of the low solder wetting area is lowered to the bent section, the low solder wetting area does not extend to the connecting section, which is below the bent section. Therefore, there is no influence at all to the soldering connection at the connecting section.

According to the invention, after applying a high solder wetting material layer as an upper layer on a low solder wetting material layer as a base layer over the whole terminal base material, if the upper layer, a high solder wetting material layer, is removed or dissolved in an area that corresponds to the low solder wetting area, the terminal exposes the base layer, low solder wetting material layer. As a result, the exposed low solder wetting material layer can form the low solder wetting area.

In the invention, it is possible to form a high solder wetting area surface by gold plating and a low solder wetting area surface by nickel plating, respectively.

In the invention, it is possible to form the low solder wetting area by removing or dissolving the high solder wetting material layer by irradiation of laser beam.

According to the invention, in a terminal that has a low solder wetting area to prevent solder wicking, since the upper end of the low solder wetting area on the backside section, where a contact section is formed, is provided lower than the upper ends of the side-face sections and the contact-face section, it is possible to secure large contact section, which is above the upper end of the low solder wetting area on the backside section, and thereby each terminal can securely contact with a terminal of a mating connector.

In addition, the backside section is a surface where solder wicking occur less, and even if the upper end of the low solder wetting area is provided lower than the upper end of the contact-face section or the side-face sections, the preventive action against the solder wicking would not be impaired. On the other hand, since the upper ends of the low solder wetting areas on the contact-face section and the side-face sections, where solder wicking occurs more highly likely that the backside section, are provided higher than the upper end of the backside section and broad low solder wetting area is secured, the preventive effect against solder wicking is satisfactorily maintained.

Accordingly, not only in a connector, in which each terminal is attached to a housing while having slight space from the housing, but also in a connector, in which each terminal is integrally molded to a housing, even if there is a possibility that a connector may have space generated by peeling after molding or the like, it is possible to prevent solder wicking.

DETAILED DESCRIPTION OF PREFERRED EMBODIMENTS

Referring now to the accompanying drawings, embodiments of the invention will be described.

Figure 1:
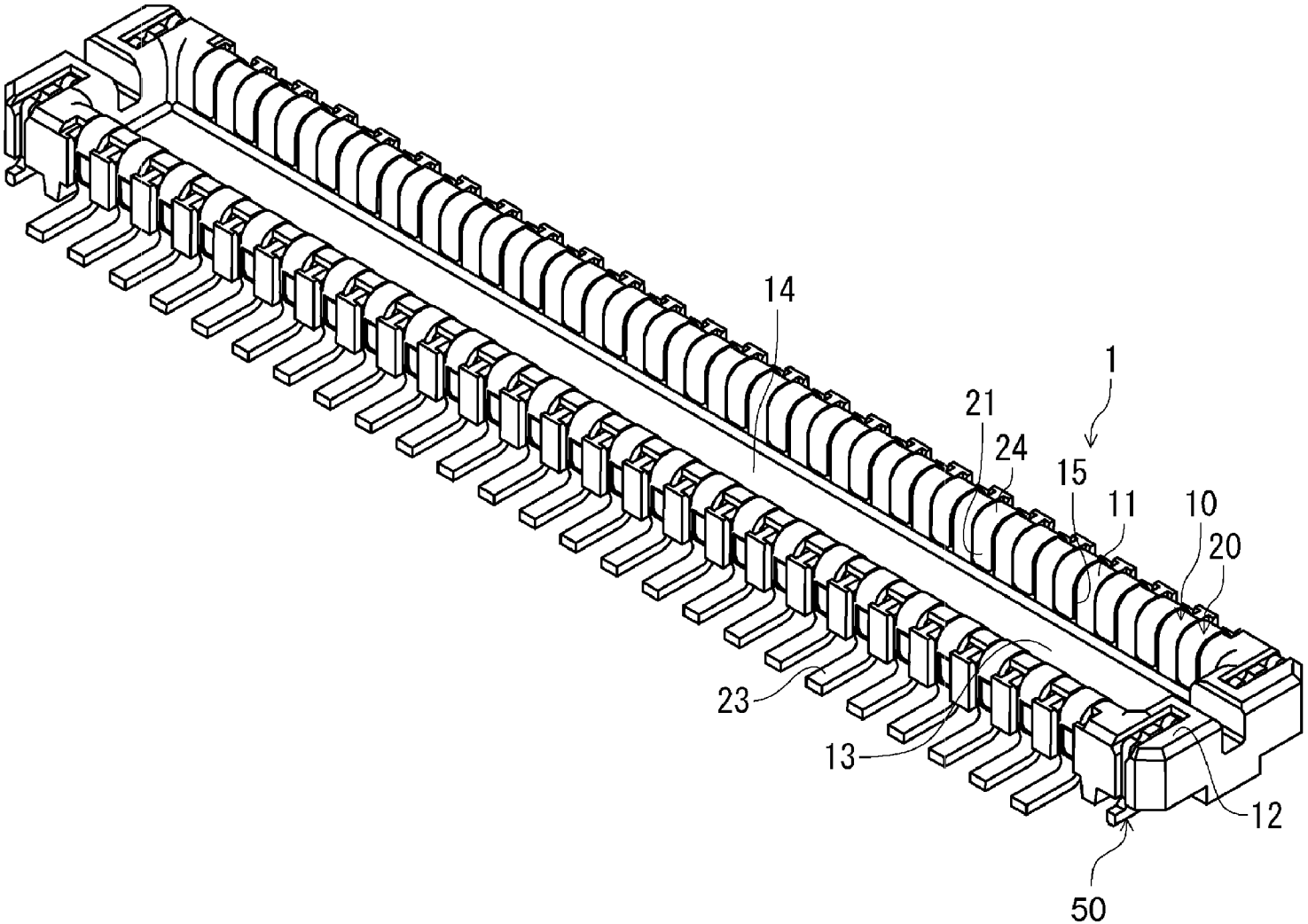
FIG. 1 is a perspective view of outer appearance of a connector according to an embodiment of the invention.

A connector 1 shown in FIG. 1 according to the embodiment has terminals 20, which are arranged and attached to a pair of side walls (wall sections) 11 that respectively extend in a longitudinal direction of a housing 10, which has a rectangular shape in the top view. In addition, the housing 10 has on its both ends in the longitudinal direction fixing brackets 50 to secure the connector 1 onto a circuit board (not illustrated).

The housing 10 is made of an electrically insulating material, and has a receiving recess 14 to receive a mating connector (not illustrated), being formed by a pair of side walls 11 facing each other and extending in the longitudinal direction, end walls 12 that connect the pair of side walls 11 at the both ends in the longitudinal direction, and a bottom wall 13 provided at the lower end sides of the side walls 11 and the end walls 12.

Figure 2:
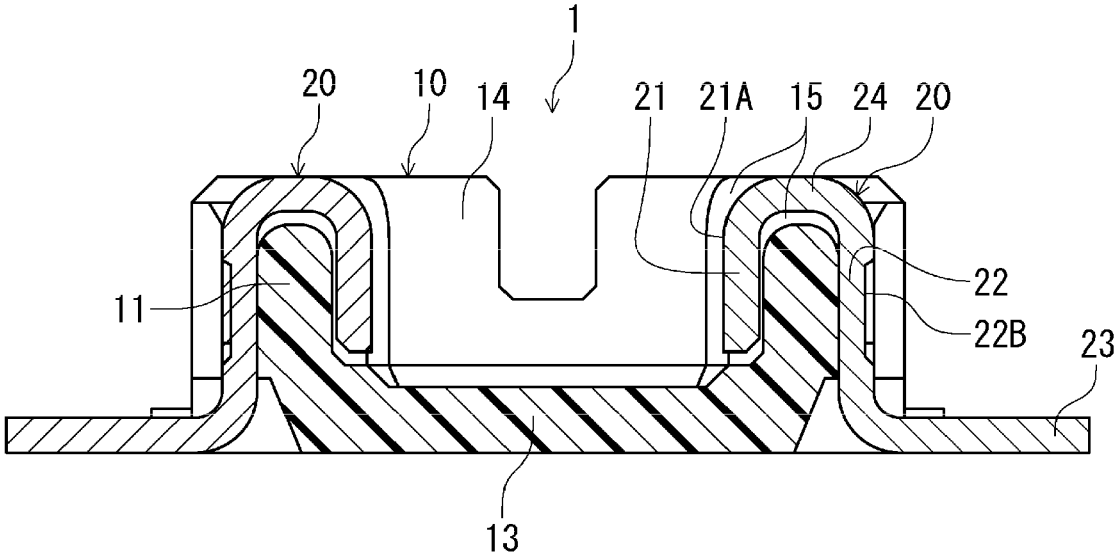
FIG. 2 is a longitudinal sectional view of the connector of FIG. 1 taken at a pair of facing terminals.

As shown in FIG. 2, the pair of the side walls 11 of the housing 10 respectively has a terminal holding groove 15 so as to be laterally symmetric to each other, and each terminal holding groove 15 extends its inner surface, upper surface and outer surface so as to form an inverse U-shape. A terminal 20 held in the terminal holding groove 15 is made by forming a flat metal rectangular strip to bend in the thickness direction, and has a contact section 21 provided on the inner surface side of the side wall 11 of the housing 10, a holding section 22 provided on the outer surface side, and a connecting section 23 that extends outward from a lower end portion of the holding section 22.

The contact section 21 and the holding section 22 are connected by a joining section 24 provided on the upper surface side of the side wall 11, so as to form an inverse U-shape by them, and each terminal is held in the terminal holding groove 15. According to the embodiment, the inverse U-shaped portion, which is formed by the contact section 21, the joining section 24, and the holding section 22 of the terminal 20 is placed in the terminal holding groove 15 from the above of the side wall 11 of the housing 10, and the both side surfaces 22A of the holding section 22 in the width direction are pressed onto the corresponding groove inner surfaces of the terminal holding groove 15 so as to be held therein.

The contact section 21 of each terminal 20 is provided on the inner surface side of the side wall 11, and a surface opposite the side wall side of the contact section 21 forms a contact surface 21A to contact with a contact section of a terminal of a mating connector. The holding section 22 provided on the outer surface side of the side wall 11 has a locking recess 22B formed on the outer surface.

The locking recess 22B receives a locking section of a terminal of a mating connector and locks thereto so as to prevent coming off of the terminal. Since the locking recess 22B contacts with a terminal of a mating connector, it also works as a supplementary contact section to the contact section 21. A lower surface of the connecting section 23 extends at the same level as that of a bottom surface of a bottom wall 13 of the housing 10, and when the connector 1 is disposed on a circuit board 1, it contacts by face with a corresponding circuit portion of the circuit board. Referring to FIG. 3, a terminal 20 of this type will be fully described below.

Figure 3A:
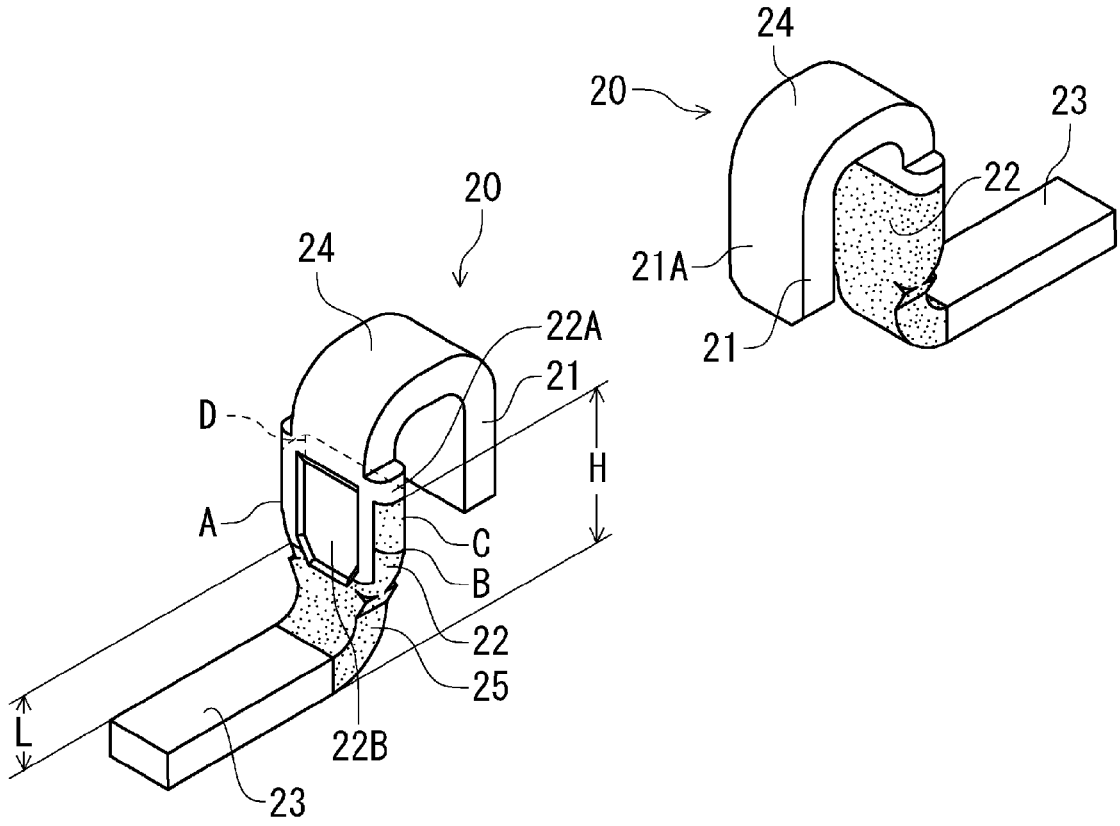
FIG. 3(A) shows only the pair of terminals of the connector in FIGS. 1 and 2.

FIG. 3(A) shows a pair of terminals 20 held by a pair of side walls 11 that respectively face the housing 10. The terminals 20 have the same shape, and are arranged in a laterally symmetric manner as shown in FIG. 3(A).

As shown in FIG. 3(A), each terminal 20 is made by bending a flat metal rectangular strip in the thickness direction and partially pressing. The joining section 24, which connects between the above-described contact section 21 and the holding section 22, forms an inverse U-shape, and a connecting section 23 horizontally extends from a bent section 25 provided on the lower end of the holding section 22.

According to the embodiment, while the contact section 21, the joining section 24, and the connecting section 23 have the same width, the holding section 22 has larger width than them and has round side surfaces. A locking recess 22B having a generally rectangular periphery is formed by press work on an outer face of the holding section 22.

In FIG. 3(A), the terminal 20 has a low solder wetting area in the area shaded with dots on the holding section 22, and has high solder wetting areas in the non-shaded areas, i.e. the contact section 21, the joining section 24, and the connecting section 23. The low solder wetting area has a surface made of a low solder wetting material with poor wettability to a soldering material such as Ni or Pd, and the high solder wetting area is made of a high solder wetting material with good wettability to a soldering material such as Au, Ag, or Su.

More specifically, for example, the whole surface of the terminal 20 may be plated with a low solder wetting material as a base layer, and subsequently plated with a high solder wetting material as an upper layer. Thereafter, by irradiation of laser or the like onto an area that corresponds to the low solder wetting area so as to remove or dissolve the high solder wetting material in the upper layer in the area, it is possible to obtain the low solder wetting area.

Figure 3B:
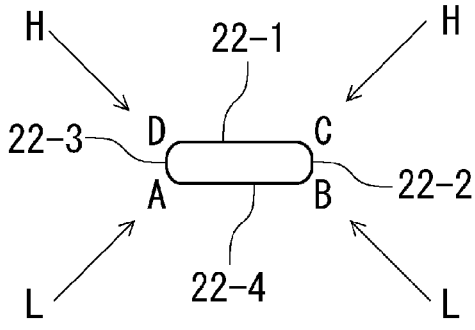
FIG. 3(B) is a sectional view of a holding section of one terminal with indication of laser irradiation directions.

In FIG. 3(A), the low solder wetting areas are formed on the holding section 22 and the bending section 25. As shown in FIG. 3(B), the holding section 22 has a contact-face section 22-1 that contacts by face to a side wall 11 of the housing 10, a backside section 22-4 that is exposed to outside and is on the other side to the contact-face section 22-1, and side-face sections 22-2 and 22-3 that respectively connect between the contact-face section 22-1 and the backside section 22-4 as a circumferential surface thereof.

The low solder wetting area is formed on the holding section 22 and the bent section 25. On the contact-face section 22-1 side and the side-face sections 22-2 and 22-3 sides, the low solder wetting area extends over the range H for the height level, whose upper end is near an upper end of the holding section 22 and whose lower end is the lower end of the bent section 25.

On the backside section 22-4 side, the low solder wetting area extends over the range L for the height level, whose upper end is near the lower end of the holding section 22 and lower end is the lower end of the bent section 25. In other words, the low solder wetting area has the upper end that is lower on the backside section 22-4 side than at the contact-face section 22-1, and side-face sections 22-2 and 22-3 sides. As a result, the locking recess 22B, which can also work as a supplementary contact section for a mating connector, is a high solder wetting area, and the locking recess 22B is formed above the upper end of the low solder wetting area on the backside section.

The low solder wetting area in the terminal 20 like this may be obtained by laser irradiation. In FIG. 3(B), which is a lateral sectional view of the holding section 22, laser beam is irradiated towards four corner sections that are slightly round, A, B, C, and D. Here, the face between A and B is the backside section 22-4, the faces between B and C and between D and A are side-face sections 22-2 and 22-3, and the face between C and D is the contact-face section 22-1.

Laser beam is irradiated onto the respective terminal surfaces with height range L for the corner sections A and B and with height range H for the corner sections C and D. As a result, on the surfaces irradiated by laser beam, the high solder wetting material in the upper layer is removed or dissolved, and thereby the low solder wetting material in the base layer becomes exposed.

Accordingly, the low solder wetting area ranged as in FIG. 3(A) is obtained. Upon laser beam irradiation, for example, since the lower end portion of the contact section 21 may block the laser beam towards the contact-face section 22-1, irradiation to the contact-face section 22-1, i.e. the irradiation in the height range H in FIG. 3(B), is preferably tilted slightly upward from the lower side, rather than in horizontal direction.

The terminal 20 of the connector 1 is connected by soldering to a corresponding circuit portion of a circuit board (not illustrated). Such soldering is done onto a bottom surface of the connecting section 23, but because of the solder wettability, it wicks onto the side faces and even the upper surface of the connecting section 23, and also may extends to the bent section 25.

However, since the bent section 25 and the holding section 22 have the low solder wetting area, the solder would not climb up anymore and does not reach the locking recess 22B, which also works as a supplementary connecting section, and therefore needless to say, it would not reach the contact section 21.

Figure 4:
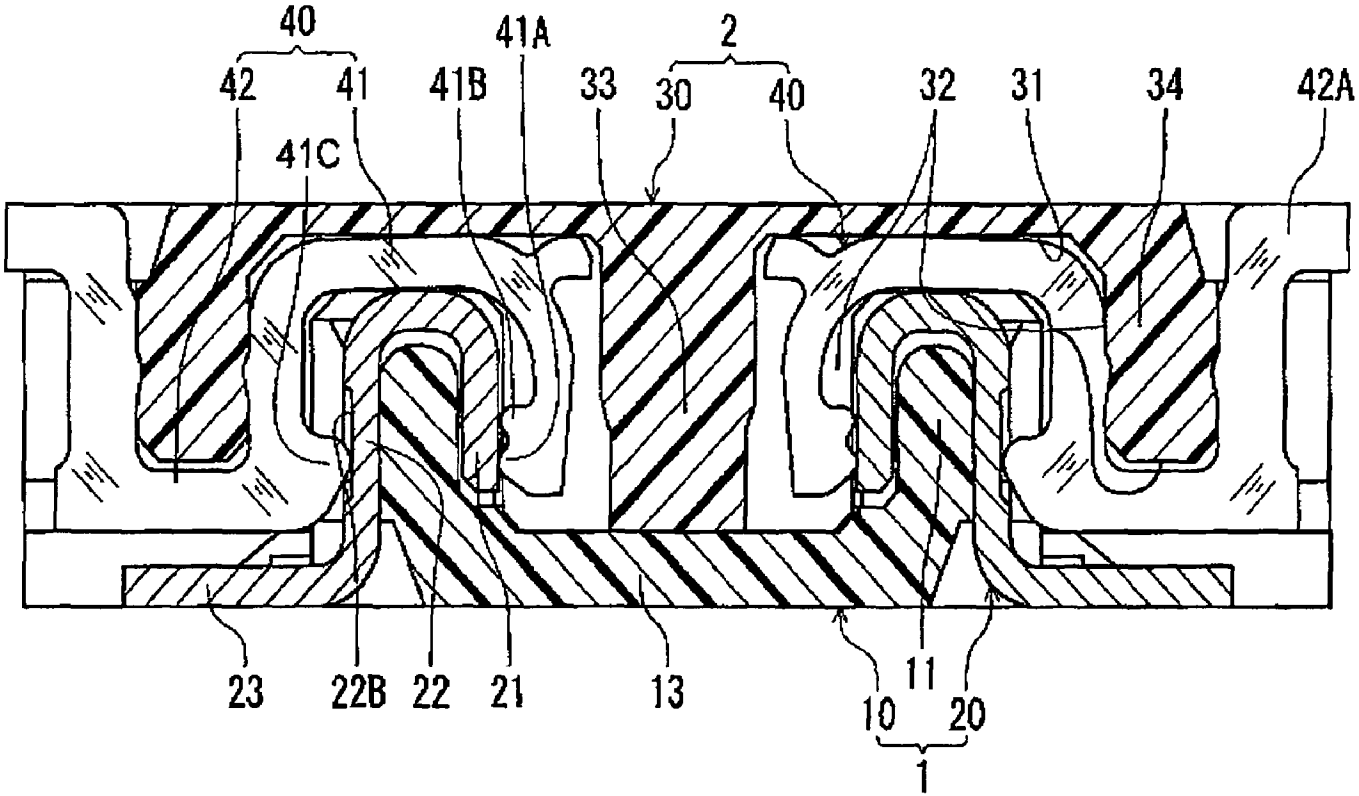
FIG. 4 is a sectional view of a fitting state of the connector of FIG. 2 and its mating connector.

The terminal 20 obtained in this way may be mounted in the housing 10 as shown in FIGS. 1 and 2 to compose the connector 1, and as shown in FIG. 4, it is connected to a terminal of a mating connector 2. In FIG. 4, in the mating connector 2, the terminals 40 are attached to the housing 30.

The housing 30 of the mating connector 2 has receiving recesses 31 formed to receive the connector 1, and has terminal receiving grooves 32 in the orthogonal direction to the paper surface in FIG. 4 corresponding to positions of terminals 20 arranged in the connector 1. The receiving recesses 31 are formed on the both sides across the center wall 33, between the center wall 33 and the side walls 34. Each terminal receiving groove 32 is formed continuously connecting the two facing inner faces and the upper bottom surface of the receiving recess 31 and the two facing outer surfaces and the bottom surface of the side wall 34.

The terminal 40 is formed from sheet metal maintaining the original flat surface so as to be placed in the terminal receiving groove 32, and has a 90-degree rotated S-shape by joining the inverse U-shape section 41 and the U-shaped section 42. The inverse U-shape section 41 is in the receiving recess 31 and the U-shaped section 42 is outside the receiving recess 31.

The inverse U-shaped section 41 of the terminal 40 has the contact section 41A and the abutting section 41B being adjacent to each other as protrusions from the lower end on the free end side. The contact section 41A elastically contacts with the contact section 21 of the terminal 20 of the connector 1, and the abutting section 41B is provided slightly away from the contact section 21.

When the connector 2 tilts upon inserting or pulling out the connector 2, the terminal 40 is prevented from coming off from the housing 30 by abutting to the contact section 21 of the terminal 20 of the connector 1. The inverse U-shaped section 41 has a locking protrusion 41C near the boundary to the U-shaped section 42, so as to face to the contact section 41A. The locking protrusion 41C is designed to prevent the connector's coming off by engaging with the locking recess 22B of the terminal 20 of the connector 1, but since the terminals can contact to each other in the same way, it can also work as a supplementary contact section.

The U-shaped section 42 of the terminal 40 has a connecting section 42A at a free end outside the receiving recess 31 and is connected by soldering to a circuit board.

Accordingly, the connector 2 fits to the connector 1 from thereabove, and the contact section 41A of each terminal 40 of the connector 2 contacts with the contact section 21 of the terminal 20 of the connector 1, and the locking protrusion 41C of the terminal 40 engages and contacts with the locking recess 22B of the terminal 20. As described above, upon connecting the terminals 20 of the connector 1 onto a circuit board at the connecting sections 23 by soldering, since there is no solder wicking at the locking recesses 22B, the locking recesses 22B can make satisfactory contact with terminals of the mating connector also as supplementary contact sections.

Figure 5:
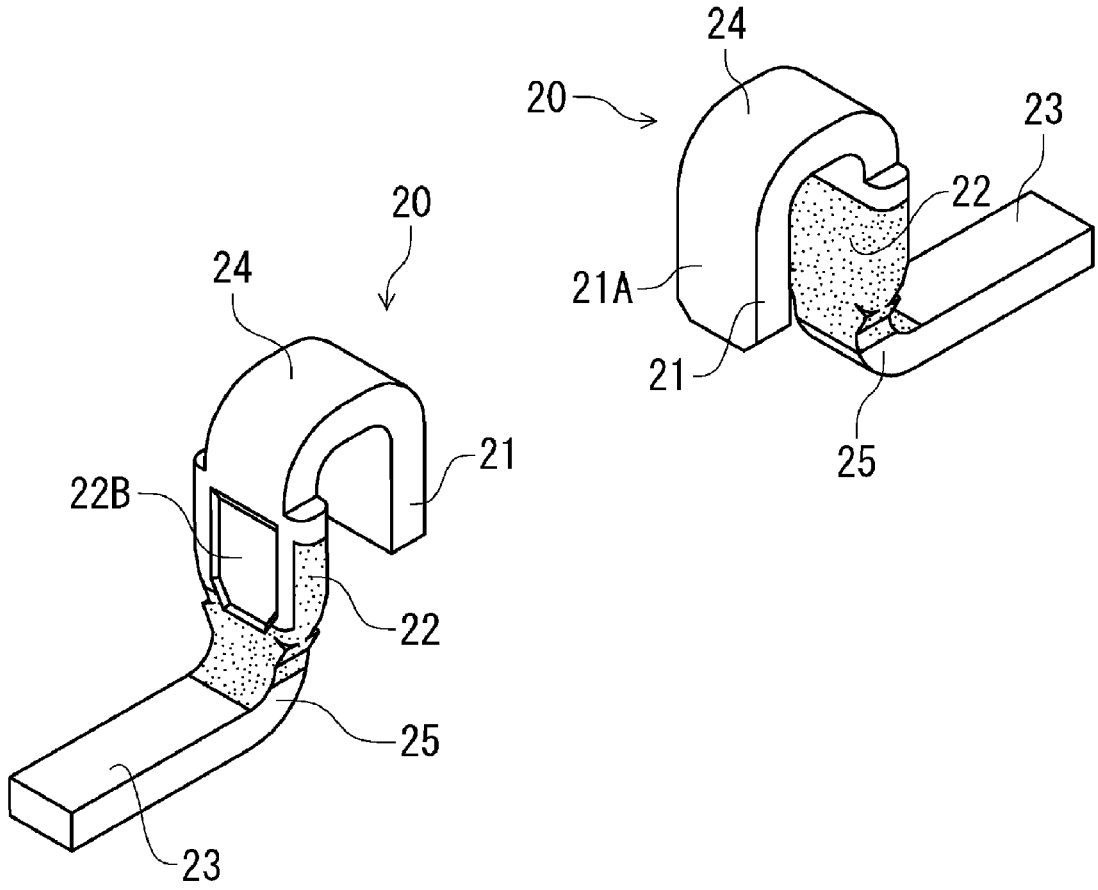
FIG. 5 is a perspective view of a modification example of the terminal.

In the invention, the lower end of the low solder wetting area of the terminal 20 may not be limited to the example of FIG. 3. For example, in order to secure wide high solder wetting area, i.e. soldering area, on the bottom surface and the side surfaces of the connecting section 23, as shown in FIG. 5, the lower end of the low solder wetting area may be set higher than the case in FIG. 3, being close to the upper end position of the bent section 25 on the side surfaces and the bottom surface of the bent section 25.

With the configuration, it is possible to increase the areas of high solder wetting areas on the bottom surface and side surfaces of the connecting section 23 so as to be effective for the soldering connection of the connecting section 23.

The bent section 25 forms wedge-like space between its bottom surface and a circuit board. Generally speaking, upon connecting terminals to a circuit board by soldering, the solder connection may be made strong in some cases by forming a so-called "fillet", which fills the wedge-like space by solder.

Figure 6:
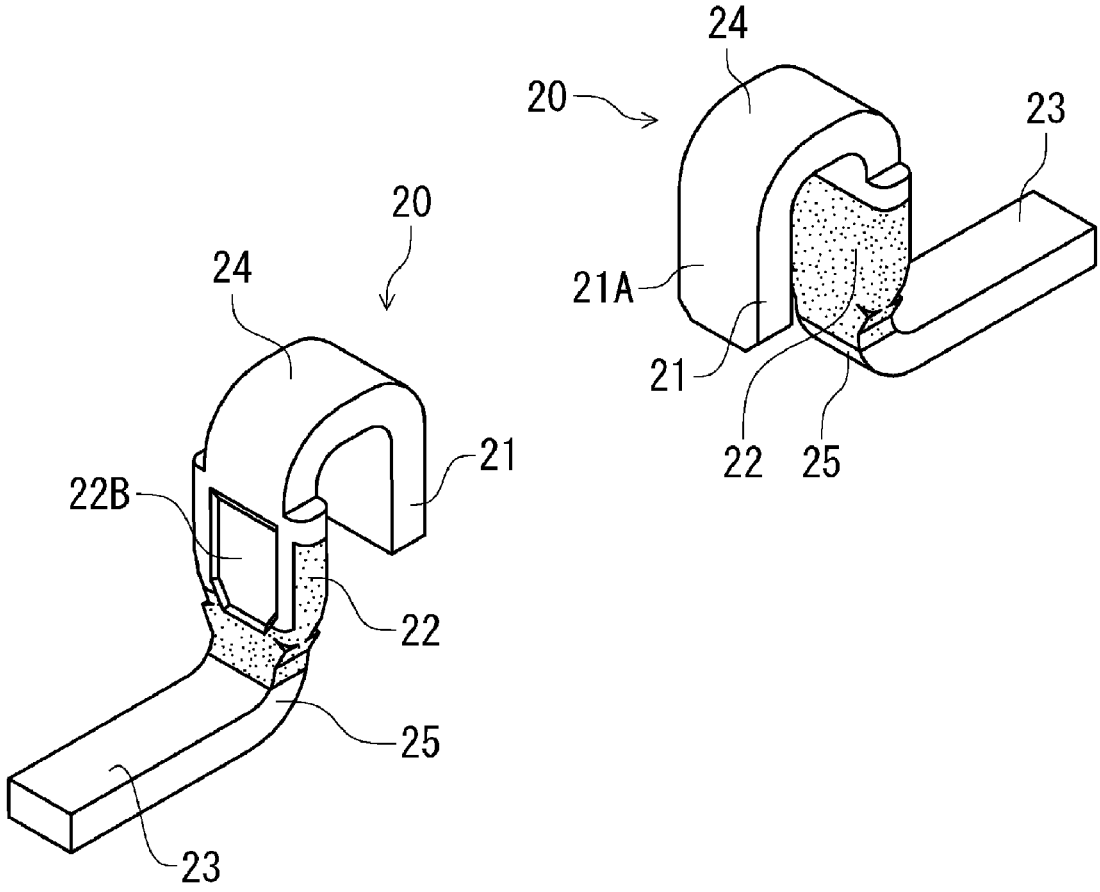
FIG. 6 is a perspective view of another modification example of the terminal.

In the embodiment, if formation of such fillet is desired, it is possible to form a fillet as high solder wetting areas on the bottom surface side of the bent section 25 in addition to the connecting section 23 by lifting the lower end of the low solder wetting area to near the upper end of the bent section 25 as shown in FIG. 6, and thereby the circumferential surface including the side surfaces and the upper surface can contribute to the solder connection.

Figure 7:
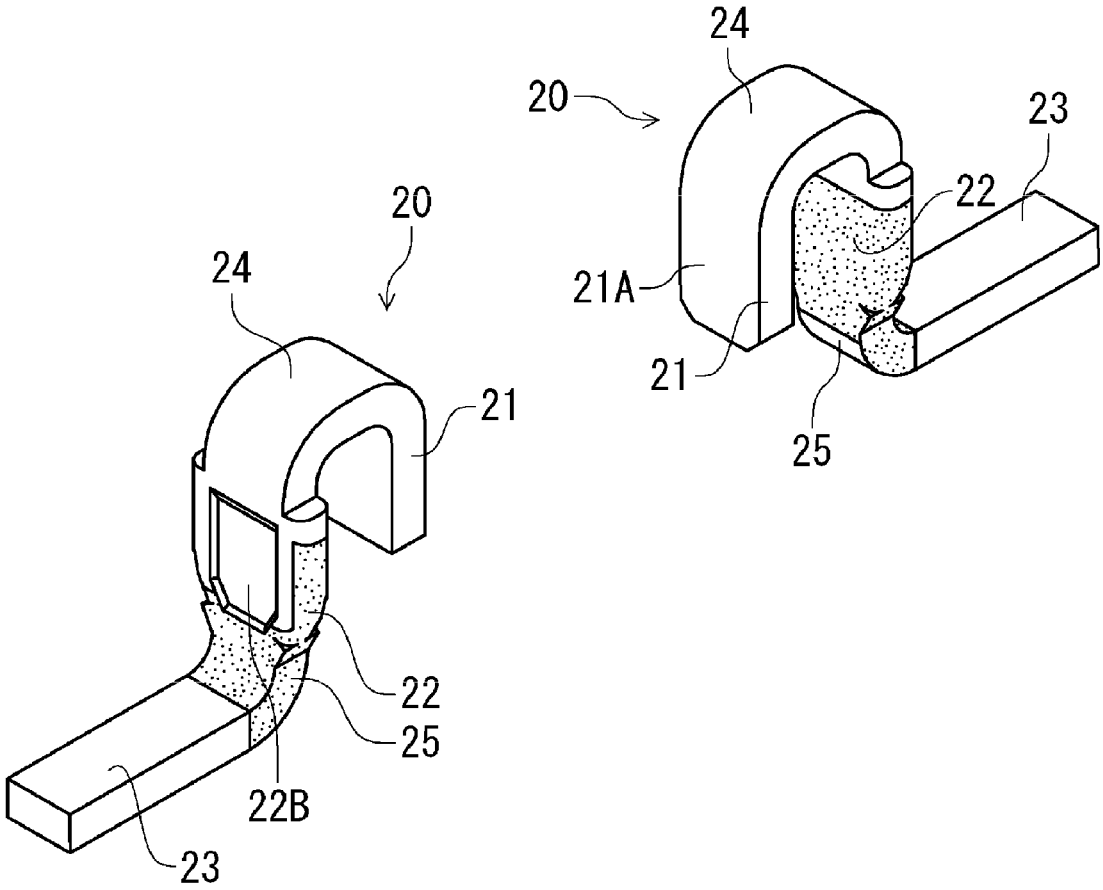
FIG. 7 is a perspective view of yet another modification example of the terminal.

In this case, if no contribution of the upper surface to the solder connection is desired, the fillet formation may be limited to the bottom surface side and the side surface sides as shown in FIG. 5. If no contribution of the side surfaces and the upper surface of the bent section 25 to the solder connection is desired, the fillet formation may be limited to the bottom surface side as shown in FIG. 7.

Needless to say, it is possible to apply the invention to other types of connectors, in which housing holds terminals by integral molding, as well as the illustrated connectors, in which terminals are attached to a connector. In case of the connectors, in which terminals are integrally molded with housing, no solder wicking problem should be expected, but in case there is space formed between holding sections of terminals and housing, the invention can work effectively.

The disclosure of Japanese Patent Application No. 2009-217398, filed on Sep. 18, 2009, is incorporated in the application.

While the invention has been explained with reference to the specific embodiments of the invention, the explanation is illustrative and the invention is limited only by the appended claims.

What is claimed is:

1. An electrical connector to be attached to a circuit board, comprising:

a terminal having a contact section on one free end side to contact with a terminal of a mating connector and a connecting section on the other free end side to be connected by soldering to a circuit portion of the circuit board, said terminal having a holding section to be held by contacting to a wall section of a housing orthogonal to a surface of a circuit board in a middle part of the terminal, said terminal having a connecting section formed by bending a lower end of the holding section and extending along a circuit board surface, said holding section having a face-contact section that contacts by face with the wall section, a backside section on the other side to the face-contact section, and a side-face section connecting between the face-contact section and the backside section, said terminal having a low solder wetting area at least on a part of a circumferential area of the holding section in a longitudinal direction except the contact section and the connecting section, said contact section being formed above an upper end of the low solder wetting area on the backside section, said upper end of the low solder wetting area on the backside section being provided below the upper end at the side-face section and the contact-face section.

2. The electrical connector according to claim 1, wherein said low solder wetting area of the terminal has a lower end at a bent section transitioning from the holding section to the connecting section.

3. The electrical connector according to claim 1, wherein said low solder wetting area of the terminal is formed as an exposed low solder wetting material layer, after applying a high solder wetting material layer as an upper layer on a low solder wetting material layer as a base layer over a whole terminal base material, when the high solder wetting material layer is removed or dissolved in an area that corresponds to the low solder wetting area so that the low solder wetting material layer is exposed as the exposed low solder wetting material layer.

4. The electrical connector according to claim 1, wherein said high solder wetting area is formed by gold plating and said low solder wetting area is formed by nickel plating, respectively.

5. The electrical connector according to claim 3, wherein said low solder wetting area is formed by removing or dissolving the high solder wetting material layer by irradiation of laser beam.

* * * * *